US005379493A

United States Patent [19]

Wu

[11] Patent Number: 5,379,493

[45] Date of Patent: Jan. 10, 1995

[54] BELT BUCKLE WITH REPLACEABLE ORNAMENTAL FACE PLATES

[76] Inventor: Ji-Won Wu, No. 20 Fwu-Der Lane Huu-Shan Street, Yan Jwu Village, Hua Tan Hsiang, Chang Hua Hsien, Taiwan, Prov. of China

[21] Appl. No.: 161,532

[22] Filed: Dec. 6, 1993

[51] Int. Cl.[6] ..... A44B 11/22

[52] U.S. Cl. ..... 24/163 K

[58] Field of Search ..... 24/163 K, 163 R; 63/29.1, 30; 224/163; 40/653

[56] References Cited

U.S. PATENT DOCUMENTS 2,316,225 4/1943 Hoffmann et al. ..... 63/29.1

4,502,188 3/1985 Kohli ..... 24/163 K

FOREIGN PATENT DOCUMENTS 2020539 11/1929 United Kingdom ..... 24/163 K

*Primary Examiner*—James R. Brittain

*Attorney, Agent, or Firm*—Bacon & Thomas

[57] ABSTRACT

A belt buckle includes a base frame for joining the ends of a belt which comprises a rectangular top recess on a top wall thereof, two parallel sliding grooves transversely disposed at two opposite sides by said rectangular top recess, two pairs of holes respectively made on two opposite ends of either sliding groove, the sliding grooves having a respective front end opened and a respective rear end closed, each hole receiving a spring and a steel ball supported on the spring, the steel ball in either hole partially projecting into either sliding groove; and an ornamental face plate mounted on the rectangular top recess on the base frame and having two guide rails respectively inserted into the sliding grooves on the base frame, the guide rails having a respective pair of recessed portions at the bottom into which the steel balls in the holes of the base frame engage respectively.

3 Claims, 3 Drawing Sheets

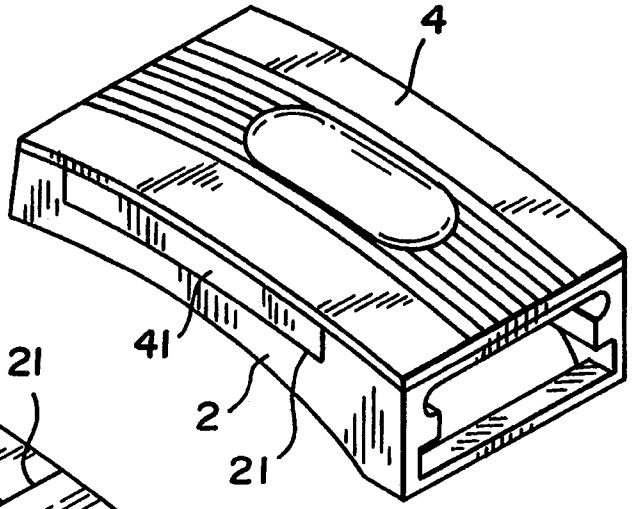
FIG. 3-B
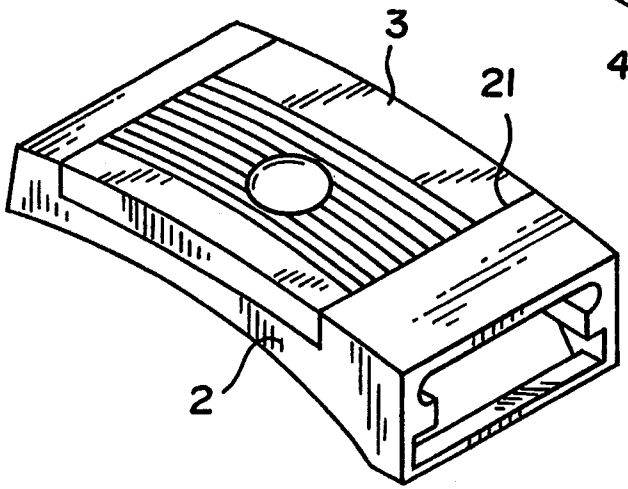
FIG. 3-A

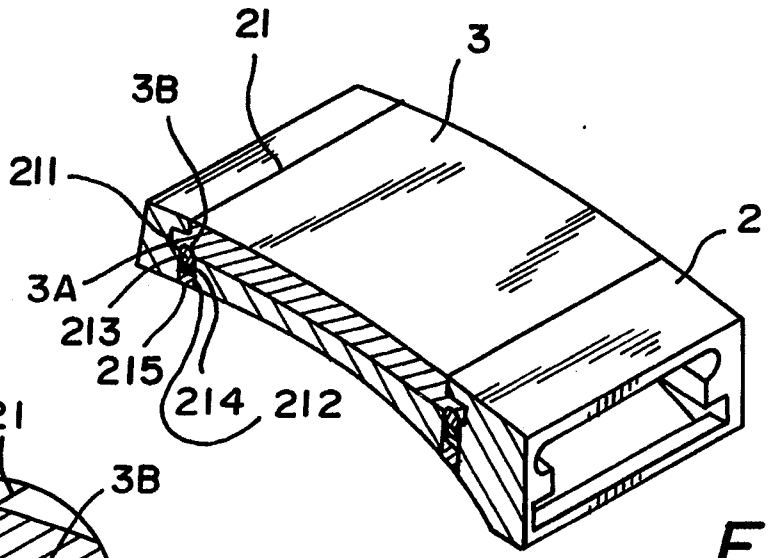
FIG. 4
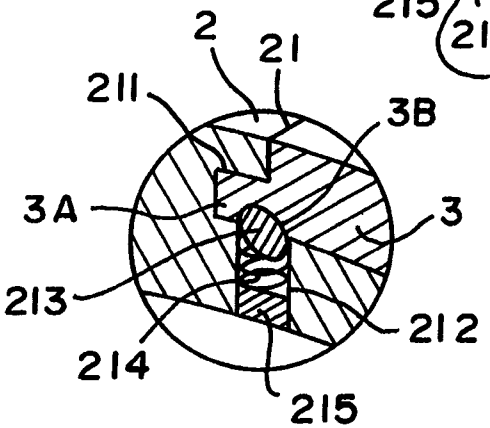
FIG. 4-A

BELT BUCKLE WITH REPLACEABLE ORNAMENTAL FACE PLATES

BACKGROUND OF THE INVENTION

The present invention relates to a belt buckle and relates more particularly to such a belt buckle having a replaceable ornamental face plate. The belt buckle has sliding grooves on two opposite sides of a rectangular top recess thereof and spring-supported steel balls in holes on the sliding grooves, and therefore different ornamental face plates can be alternatively and replaceably fastened to the belt buckle like a lidless box made to slide in and out of a table.

The belt which is to be worn round the waist to hold the trousers is commonly attached with a belt buckle for joining the ends of the belt. Belts or belt buckles of different colors and designs may be used to match trousers of different colors and designs. However, it is not economic to prepare various belt buckles or belts in order to match trousers of different colors and designs. Further, frequently changing a belt buckle from one belt to another may cause the fastening device of the belt buckle damaged easily.

FIG. 1 shows a belt buckle having a replaceable ornamental plate. The ornamental plate can be conveniently detached from the base frame, and therefore a replacement of the same structure in a different design can be alternatively fastened to the base frame. However, this structure of belt buckle is still not satisfactory in function. Because the base frame and the ornamental plate are designed to hold either end of the belt, the base frame and the ornamental plate are stretched from each other when the belt is worn round the waist, and therefore the connecting parts between the base frame and the ornamental plate may be loosened or damaged easily. Another drawback of this structure of belt buckle is that the belt must be unfastened each time the ornamental plate is to be replaced. Further, because the base frame and the ornamental plate are connected in series, an ornamental design which cover the whole area of the outside surface of the belt buckle cannot be kept in integrity. In order to keep the ornamental design in integrity, it can only be made on the ornamental plate, namely, partial area of the outside surface of the belt buckle.

SUMMARY OF THE INVENTION

The present invention has been accomplished to provide a belt buckle with a replaceable ornamental face plate which eliminates the aforesaid drawbacks. It is therefore an object of the present invention to provide a replaceable ornamental face plate for a belt buckle which can be conveniently replaced without unfastening the belt. It is another object of the present invention to provide a replaceable ornamental face plate for a belt buckle which covers the whole outside surface of the belt buckle to add beauty to the belt buckle. It is still another object of the present invention to provide a replaceable ornamental face plate for a belt buckle which does not affect the structural strength of the belt buckle.

According to one aspect of the present invention, the belt buckle comprises a base frame for joining the ends of a belt, and an ornamental face plate replaceably fastened to the base frame. The base frame comprises a rectangular top recess on a top wall thereof, two parallel sliding grooves transversely disposed at two opposite sides by said rectangular top recess, two pairs of holes respectively made on two opposite ends of either sliding groove. The sliding grooves have a respective front end opened and a respective rear end closed. The hole at either end of either sliding groove receives a spring and a steel ball supported on the spring. The steel ball in either hole partially projects into either sliding groove. The ornamental face plate is mounted on the rectangular top recess on the base frame, having two guide rails respectively inserted into the sliding grooves on the base frame. The guide rails have a respective pair of recessed portions at the bottom into which the steel balls in the holes of the base frame engage respectively.

According to another aspect of the present invention, the ornamental face plate fits into the rectangular recess and is disposed in flush with the top wall of the base frame.

According to still another aspect of the present invention, the ornamental face plate has an ornamental top wall covered over the top wall of the base frame.

BRIEF DESCRIPTION OF THE DRAWINGS

FIG. 3A is an elevational view showing a flush type ornamental face plate fastened to the base frame of the belt buckle according to the present invention;

FIG. 3B is an elevational view showing a full-cover type ornamental face plate fastened to the base frame of the belt buckle according to the present invention;

FIG. 4A is a cutaway of FIG. 3A;

FIG. 4B is a partial sectional view taken on FIG. 4A.

DETAILED DESCRIPTION OF THE PREFERRED EMBODIMENT

Figures 1, 2:
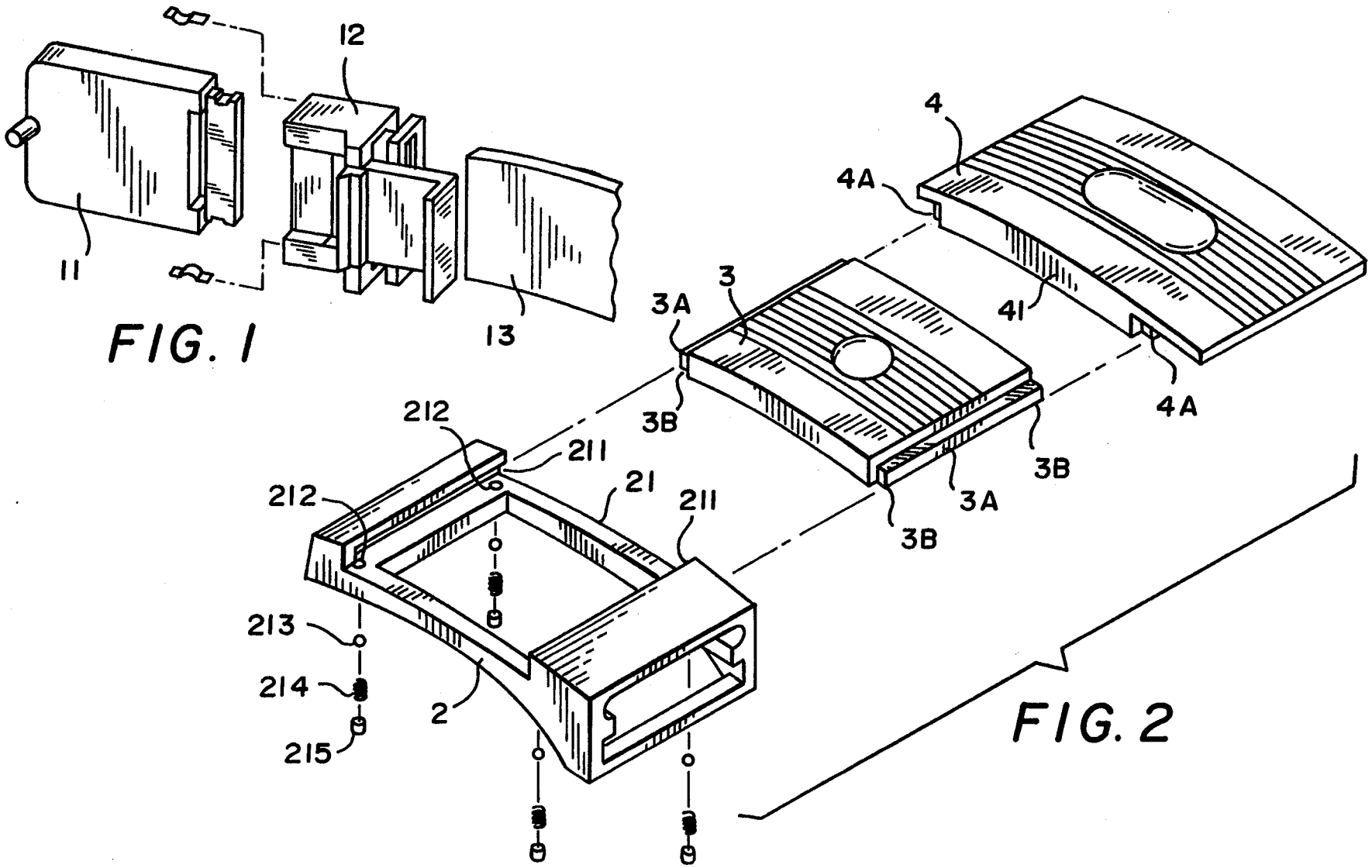
FIG. 1 is an exploded view of a belt buckle according to the prior art.
FIG. 2 is an exploded view of a belt buckle according to the preferred embodiment of the present invention.

Referring to FIGS. 2, 3A, and 3B, a belt buckle in accordance with the present invention is generally comprised of a base frame 2, a flush type ornamental face plate 3 and a full-cover type ornamental face plate 4 alternatively fastened to the base frame 2.

The base frame 2 comprises a fastening device (not shown) to hold one end of the belt, a rectangular top recess 21, two parallel sliding grooves 211 transversely disposed at two opposite sides by the rectangular top recess 21, and two pairs of opposite through holes 212 respectively made on two opposite ends of either sliding groove 211. Each sliding groove 211 has one end opened and an opposite end closed. Through the sliding grooves 211 on the base frame 2, the ornamental face plate 3 or 4 can be moved to slide in and out of the base frame 2 (this will be described further. Each through hole 212 receive a steel ball 213 and a spring 214, and is then sealed with a locating plug member 215 at the bottom for permitting the steel ball 213 to be supported on the spring 214 above the locating plug member 215. When set, the steel ball 213 partially projects out of the respective through hole 212 to stop the flush type ornamental face plate 3 in position (see FIG. 4 and 4A).

Referring to FIGS. 4 and 4A and FIGS. 2, 3A and 3B again, the flush type ornamental face plate 3 is made of rectangular shape slightly smaller than the rectangular recess 21 on the base frame 2, having two guide rails 3A on two opposite shorter sides thereof respectively inserted into the sliding grooves 211 on the base frame 2. Each guide rail 3A has two recessed portions 3B near two opposite ends thereof at the bottom. As the guide rails 3A of the flush type ornamental face plate 3 are respectively inserted into the sliding grooves 211, the steel balls 213 in the holes 212 will respectively engage into the recessed portions 3B to hold the flush type ornamental face plate 3 in the rectangular top recess 21. When the flush type ornamental face plate 2 is mounted on the rectangular top recess 21, it is disposed in flush with the topmost edge of the base frame 2. The full-cover type ornamental face plate 4 fits over the base frame 2 at the top, having a rectangular bottom block 41 fitted into the rectangular top recess 21 of the base frame 2. The structure of the rectangular bottom block 41 is similar to the flush type ornamental face plate 3, having two guide rails 4A on two opposite shorter sides thereof. The guide rails 4A of the rectangular bottom block 41 of the full-cover type ornamental face plate 4 have a respective pair of opposite recessed portions 4B (not shown) at the bottom. By inserting the guide rails 4A of the rectangular bottom block 41 into the sliding grooves 211, the steel balls 213 in the holes 212 will respectively engage into the recessed portions 4B on the guide rails 4A to hold the full-cover ornamental face plate 4 in place. Therefore, the flush type ornamental face plate 3 and the full-cover type ornamental face plate 4 can be alternatively fastened to the base frame 2.

When the belt is worn round the waist by the belt buckle, the ornamental face plate 3 (4) can be directly removed from the base frame 2 by pulling it out of the sliding grooves 211 without unfastening the belt from the waist, and then another ornamental face plate 4 (3) can be directly fastened to the base frame 2 by inserting the guide rails 4A (3A) into the sliding grooves 211. As the ornamental face plate 3 (4) is pulled outwards from the sliding grooves 211, the steel balls 213 will be forced to compress the respective springs 214 and to release from the recessed portions 3B (4B) for letting the ornamental face plate 3 to be taken out of the sliding grooves 211. Therefore replacing the ornamental face plate 3 (4) is easy.

While only one embodiment of the present invention has been shown and described, it will be understood that various modifications and changes could be made without departing from the spirit and scope of the invention. For example, different ornamental patterns or openings may be made on the ornamental face plates 3;4 to add beauty.

What is claimed is:

1. A belt buckle comprising:

a base frame for joining the ends of a belt which comprises a rectangular top recess on a top wall thereof, two parallel sliding grooves transversely disposed at two opposite sides by said rectangular top recess, two pairs of holes respectively made on two opposite ends of either sliding groove, said sliding grooves having a respective front end opened and a respective rear end closed, each hole receiving a spring and a steel ball supported on the spring, the steel ball in either hole partially projecting into either sliding groove; and an ornamental face plate mounted on the rectangular top recess on the base frame and having two guide rails respectively inserted into said sliding grooves on said base frame, said guide rails having a respective pair of recessed portions at the bottom into which the steel balls in said holes of said base frame engage respectively.

2. The belt buckle of claim 1 wherein said ornamental face plate fits into said rectangular recess and is disposed in flush with the top wall of said base frame.

3. The belt buckle of claim 1 wherein said ornamental face plate has an ornamental top wall covered over the top wall of said base frame.

* * * * *